US008451081B2

(12) United States Patent
Kobayashi et al.

(10) Patent No.: US 8,451,081 B2
(45) Date of Patent: May 28, 2013

(54) COIL ASSEMBLY HAVING PIN SUPPORT PORTIONS OF DIFFERENT LENGTH

(75) Inventors: Katsumi Kobayashi, Tokyo (JP); Katsuhiro Ishigaki, Tokyo (JP)

(73) Assignee: TDK Corporation, Tokyo (JP)

( * ) Notice: Subject to any disclaimer, the term of this patent is extended or adjusted under 35 U.S.C. 154(b) by 93 days.

(21) Appl. No.: 13/013,326

(22) Filed: Jan. 25, 2011

(65) Prior Publication Data

US 2011/0215892 A1 Sep. 8, 2011

(30) Foreign Application Priority Data

Mar. 8, 2010 (JP) ..... 2010-050361

(51) Int. Cl.
*H01F 27/29* (2006.01)
*H01F 27/30* (2006.01)

(52) U.S. Cl.
USPC ..... 336/192; 336/196; 336/198

(58) Field of Classification Search
USPC ..... 336/192, 196, 198
See application file for complete search history.

(56) References Cited

U.S. PATENT DOCUMENTS

| | | | | |
|---|---|---|---|---|
| 5,696,477 | A * | 12/1997 | Yamamori et al. | 336/192 |
| 6,661,187 | B1 * | 12/2003 | Park | 315/411 |
| 2002/0070833 | A1 * | 6/2002 | Junjie et al. | 336/198 |

FOREIGN PATENT DOCUMENTS

| | | |
|---|---|---|
| JP | U-64-13712 | 1/1989 |
| JP | A-8-111323 | 4/1996 |
| JP | A-8-273943 | 10/1996 |
| JP | A-10-223451 | 8/1998 |
| JP | A-2000-124025 | 4/2000 |

OTHER PUBLICATIONS

Feb. 23, 2012 Office Action issued in Japanese Patent Application No. 2010-050361 (with translation).

* cited by examiner

*Primary Examiner* — Mohamad Musleh
*Assistant Examiner* — Tsz Chan
(74) *Attorney, Agent, or Firm* — Oliff & Berridge, PLC

(57) ABSTRACT

A coil assembly having a simplified bobbin structure and facilitating connection of a draw-out portion of a wire to a pin terminal. A coil assembly includes first and second pin support portions protruding in a protruding direction from a terminal base. First and second pin terminals protrude in the protruding direction from free end faces of the first and second pin support portions, respectively. The draw-out portion is electrically connected to an associated one of the pin terminals. The second pin support portion provides a protruding length from the terminal base greater than that of the first pin support portion, and the free end face of the second pin support portion is positioned downstream, in the protruding direction, of an imaginary linear draw-out portion directed linearly from the wire engaging portion to the first pin terminal, such that the second pin support portion is positioned and sized to intersect with the imaginary linear draw-out portion.

5 Claims, 6 Drawing Sheets

COIL ASSEMBLY HAVING PIN SUPPORT PORTIONS OF DIFFERENT LENGTH

CROSS REFERENCE TO RELATED APPLICATION

This application claims priority from Japanese Patent Application No. 2010-50361 filed Mar. 8, 2010. The entire content of the priority application is incorporated herein by reference.

TECHNICAL FIELD

The present invention relates to a coil assembly, and more particularly, to a type thereof including a bobbin having a terminal base, a plurality of terminal electrodes provided at the terminal base, and a plurality of coils wound over the bobbin and each having one end portion and another end portion electrically connected to associated terminal electrodes.

BACKGROUND

A coil assembly such as a transformer includes a bobbin and coils or conductive wires wound over the bobbin. The bobbin has generally cylindrical shape, and a plurality of wires each coated with an electrically insulation layer are wound over an outer peripheral surface of the bobbin. Each wire has a winding portion wound over the bobbin and draw-out portions at each end portion of the wire.

Japanese Patent Application Publication No. H08-111323 discloses a coil assembly in which a terminal base is provided at one axially end portion of a cylindrical portion. The terminal base is provided with a plurality of pin terminals protruding in a direction perpendicular to a circuit board when the coil assembly is surface-mounted on the board. The terminal base is provided with an engaging portion protruding outward so as to engage the draw-out portion of the wire and to direct the draw-out portion toward the pin terminal. Each end portion of the wire is wound over the pin terminal and is electrically connected thereto.

SUMMARY

In such conventional structure, the draw-out portion of the wire is drawn out of the winding portion and is engaged with the engaging portion, and is then drawn to the pin terminal. Therefore, cumbersome production of the coil assembly is required such as engaging the draw-out portion with the engaging portion and winding the draw-out portion over the pin terminal. Further, complicated bobbin structure results.

It is therefore, an object of the present invention to provide a coil assembly having a simplified bobbin structure and capable of facilitating the drawing out work of the draw-out portion toward the pin terminal.

This and other object of the present invention will be attained by a coil assembly to be mounted on a circuit board including a bobbin, at least one electrically conductive wire, first and second pin support portions, and first and second pin terminals. The bobbin is made from an electrically insulating material and includes a wound portion having an end portion, a wire engaging portion, and a terminal base positioned at the end portion. The at least one electrically conductive wire has an electrically insulation coating and includes a winding portion wound over the wound portion and draw-out portions each drawn out from the winding portion and engaged with the wire engaging portion. The first pin support portion and the second pin support portion protrude in a protruding direction from the terminal base. The first pin terminal protrudes in the protruding direction from a free end face of a first pin support portion and is supported thereto. The second pin terminal protrudes in the protruding direction from a free end face of the second pin support portion and is supported thereto. The draw-out portion is electrically connected to associated one of the pin terminals. The pin terminals are configured to extend through the circuit board in the protruding direction which is substantially perpendicular to a surface of the circuit board. The second pin support portion provides a protruding length from the terminal base greater than that of the first pin support portion, and the free end face of the second pin support portion is positioned downstream, in the protruding direction, of an imaginary linear draw-out portion directed linearly from the wire engaging portion to the first pin terminal, such that the second pin support portion is positioned and sized to intersect with the imaginary linear draw-out portion.

DETAILED DESCRIPTION

A coil assembly according to a first embodiment of the present invention will be described with reference to FIGS. 1 through 4. The coil assembly in this embodiment is a transformer including a core 10, a bobbin 20, and a conductive wire 50. Throughout the description, a direction from an upper right portion to a lower left portion in FIG. 1 will be referred to as "+X direction", a direction opposite to the +X direction will be referred to as "−X direction", a direction from a lower right portion to an upper left portion will be referred to as "+Y direction", a direction opposite to the +Y direction will be referred to as "−Y direction", a direction from the lower portion to the upper portion will be referred to as "+Z direction", and a direction opposite to the +Z direction will be referred to as "−Z direction".

Figure 1:
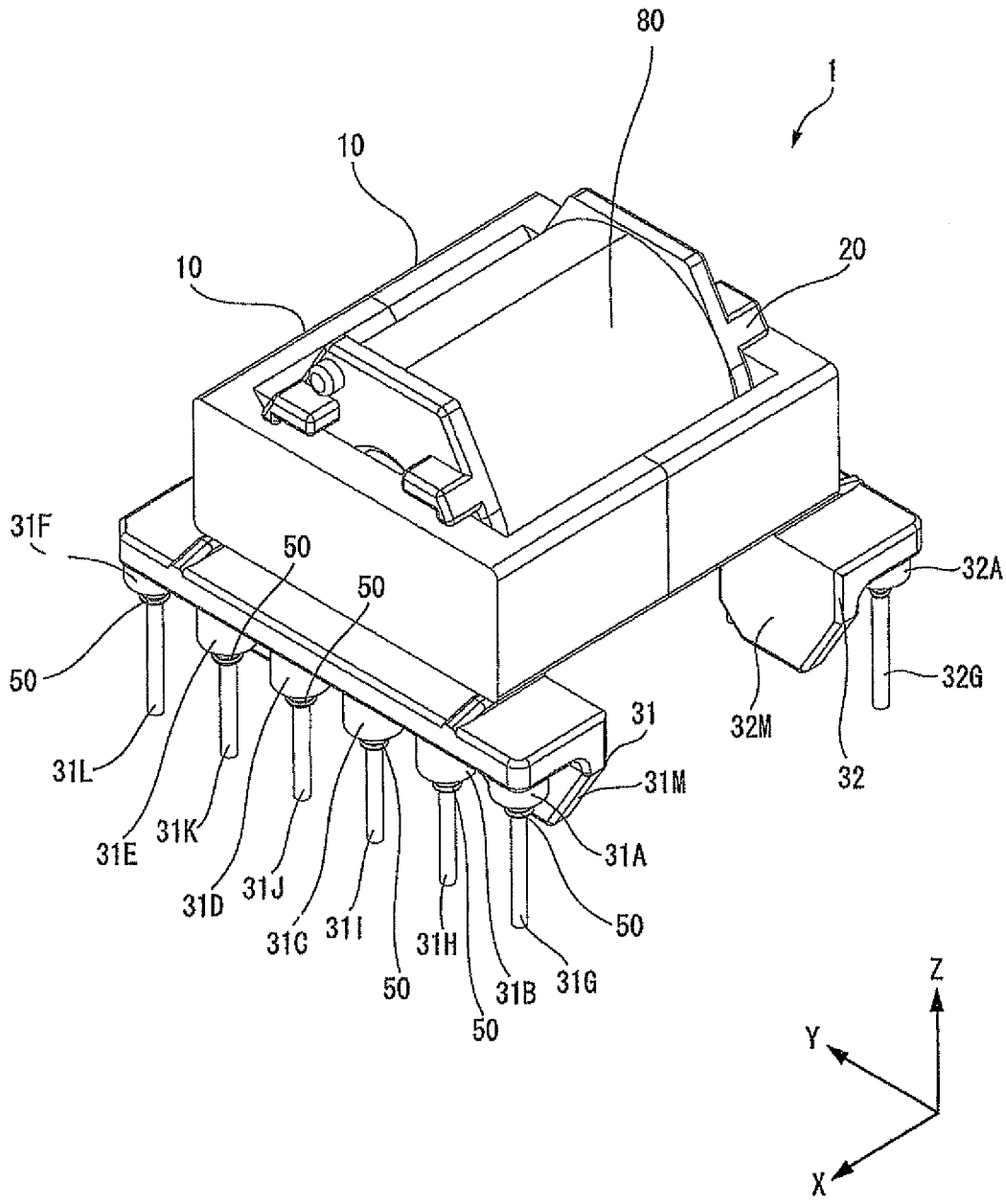
FIG. 1 is a perspective view of a coil assembly according to one embodiment of the present invention.
Figure 2:
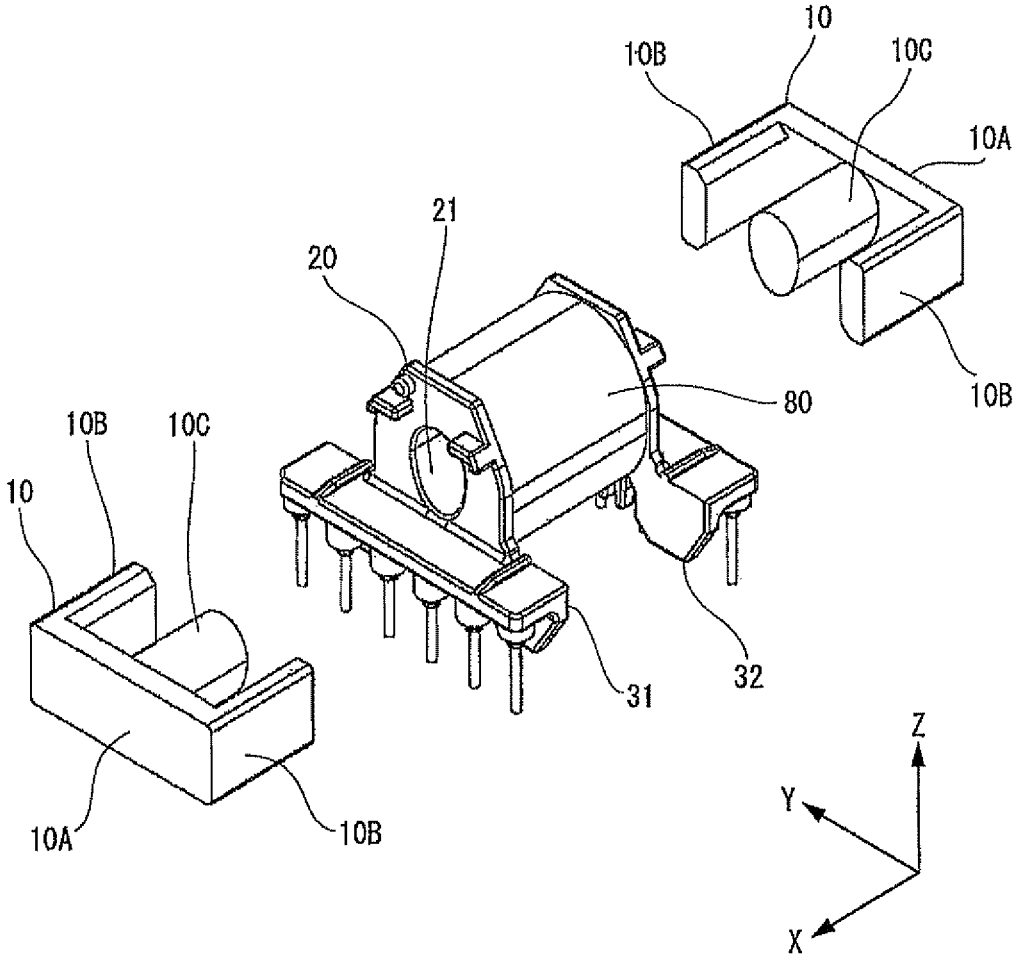
FIG. 2 is an exploded perspective view of the coil assembly according to the embodiment.

As shown in FIG. 2, a pair of the cores 10 having a shape identical to each other are provided. Each core 10 is E-shaped and includes a bottom plate portion 10A, a pair of side plate portions 10B each extending from each end portion of the bottom plate portion 10A, and a central stem portion 10C extending from a longitudinally center portion of the bottom plate portion 10A. Free end faces of the side plate portions 10B of one of the cores 10 are in contact with free end faces of the side plate portions 10B of the remaining one of the cores 10, whereas a free end face of the central stem portion 10C of one of the cores 10 is spaced apart by a predetermined distance from a free end face of the central stem portion 10C of the remaining one of the cores 10.

As shown in FIG. 2, the bobbin 20 has a sleeve portion 21 having a generally cylindrical shape and made from an electrically insulating resin. The sleeve portion 21 has a generally circular cross-section taken along a plane extending perpendicular to the X direction. The sleeve portion 21 has a cylindrical hollow space into which the central stem portions 10C of the cores 10 are inserted. The sleeve portion 21 has an axial length of about 18 mm. The sleeve portion 21 corresponds to a wound portion.

A terminal base 31 is provided at one axial end of the sleeve portion 21, and another terminal base 32 is provided at another axial end of the sleeve portion 21. The terminal bases 31, 32 are made from an electrically insulation resin the same as that of the sleeve portion 21, and are provided integrally with the sleeve portion 21. Each terminal base 31, 32 extends in a direction parallel to the Y direction.

Figure 3:
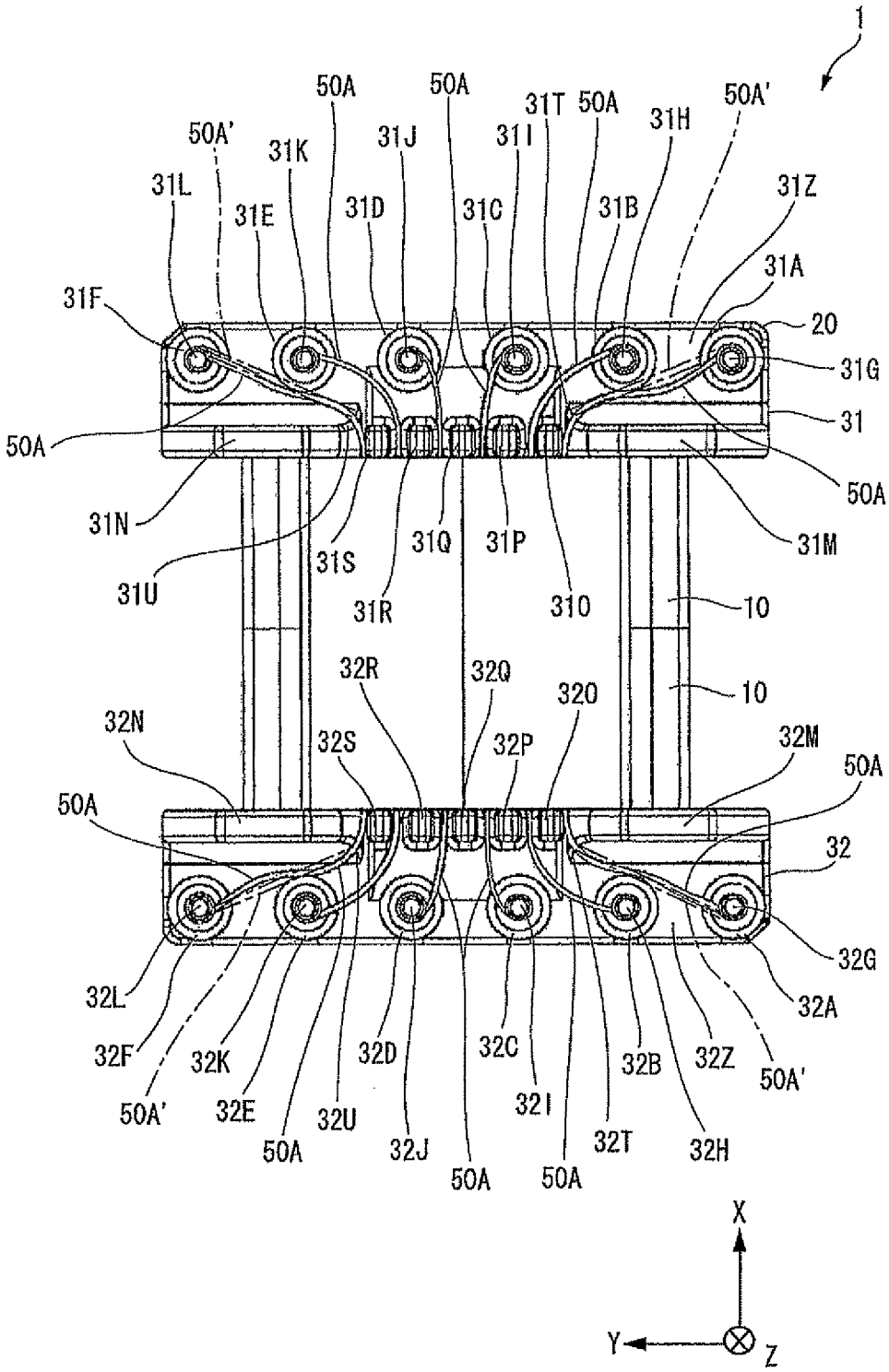
FIG. 3 is a bottom view of the coil assembly according to the embodiment.

As shown in FIG. 3, the terminal base 31 has a bottom surface 31Z provided with pin support portions 31A, 31B, 31C, 31D, 31E, 31F, terminal electrodes 31G, 31H, 31I, 31J, 31K, 31L, wire following wall portions 31M, 31N, and wire following rectangular protrusions 31O, 31P, 31Q, 31R, 31S. Similarly, the terminal base 32 has a bottom surface 32Z provided with pin support portion 32A, 32B, 32C, 32D, 32E, 32F, terminal electrodes 32G, 321J, 32I, 32J, 32K, 32L, wire following wall portions 32M, 32N, and wire following rectangular protrusions 32O, 32P, 32Q, 32R, 32S.

The wire following wall portions 31M, 31N are positioned at extreme −X end position of the bottom surface 31Z, and positioned at each end portion of the bottom surface 31Z in the Y direction. The wire following wall portions 31M, 31N are plate shaped extending in Y direction and protruding in −Z direction. A base end portion of each wire following wall portion 31M, 31N is provided with a slope portion 31T, 31U each having a first region extending in +X direction and a second region extending in Y direction. The slope portions 31T, 31U correspond to engaging portions.

Similarly, the wire following wall portions 32M, 32N are positioned at extreme +X end position of the bottom surface 32Z, and positioned at each end portion of the bottom surface 32Z in the Y direction. The wire following wall portions 32M, 32N are plate shaped extending in Y direction and protruding in −Z direction. A base end portion of each wire following wall portion 32M, 32N is provided with a slope portion 32T, 32U each having a first region extending in +X direction and a second region extending in Y direction. The slope portions 32T, 32U correspond to engaging portions.

The wire following rectangular protrusions 31O through 31S are positioned between the wire following wall portions 31M and 31N and arrayed in Y direction. Neighboring wire following rectangular protrusions are spaced away from each other by a constant predetermined interval. Further, the wire following wall portion 31 is spaced away from the neighboring rectangular protrusion 31O by the predetermined interval, and wire following wall portion 31N is spaced away from the neighboring rectangular protrusion 31S by the predetermined interval. The wire following rectangular protrusions 31O through 31S have quadrangular prism shape and extend in −Z direction. These wire following rectangular protrusions 31O through 31S correspond to the engaging portions. The same is true with respect to wire following rectangular protrusions 32O, 32P, 32Q, 32R, 32S, and geometrical relationship to wire following wall portions 32M, 32N.

The pin support portions 31A through 31F are provided at extreme +X end portion of the bottom surface 31Z, and are arrayed in Y direction with a constant interval. Each pin support portion has a cylindrical shape and extends in −Z direction from the bottom surface 31Z. Each free end portion of each pin support portion is roundish shaped. The pin support portions 32A through 32F are provided at extreme −X end portion of the bottom surface 32Z, and have geometrical relationship and configuration the same as those of the pin support portions 31A through 31F.

Figure 4:
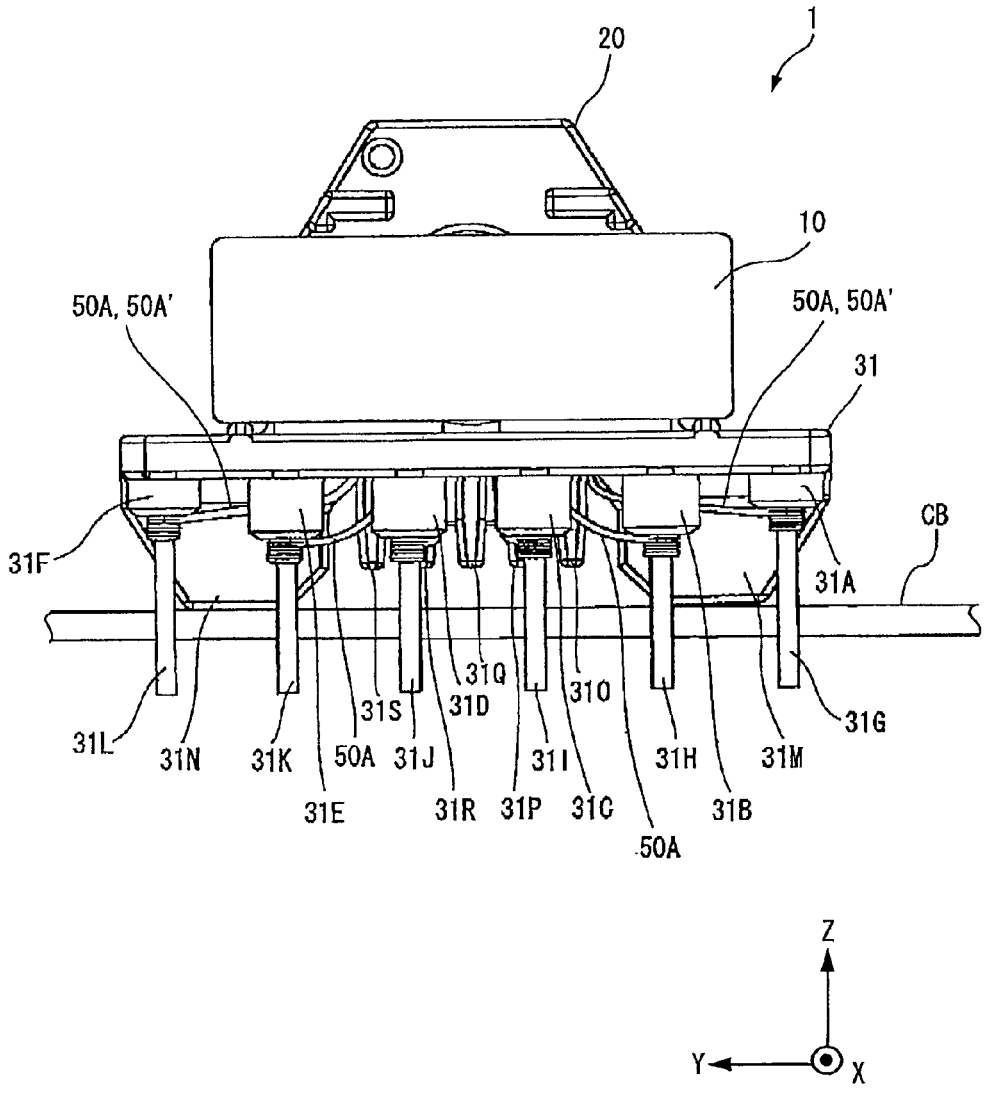
FIG. 4 is a front elevational view of the coil assembly according to the embodiment.

As shown in FIG. 4, the pin support portions 31A, 31, provided at extreme end portions in the Y direction provide a protruding length from the bottom surface 31Z smaller than that of the pin support portions 31B, 31C, 31D, 31E. Further the protruding length of the pin support portions 31A and 31F is equal to each other, and protruding length of the pin support portions 31B, 31C, 31D, 31E is equal to one another. The same is true with respect to the protruding length from the bottom surface 32Z regarding the pin support portions 32A through 32F.

As shown in FIG. 4, the pin support portion 31B, 31E next to the pin support portion 31A, 31L provide the protruding length such that an imaginary linear draw-out portion 50A' drawn from the slope portions 31T, 31U to peripheral surfaces of pin terminals 31G, 31L (described later) for winding over the pin terminals 31G, 31L can be positioned to overlap with the pin support portion 31B, 31E in the Z direction. In other words, a lower end face of the pin support portion 31B, 31E is positioned at −Z side with respect to the imaginary linear draw-out portion 50A', i.e., the lower end face of the pin support portion 31B, 31E is positioned downstream of the imaginary linear draw-out portion 50' in the −Z direction. Stated differently, the imaginary linear draw-out portion 50A' is intersected with or crossed with the peripheral surface of the pin support portion 31B, 31E as shown in FIG. 3. The protruding length of the pin support portion 31A, 31F is about 1 mm smaller than that of the pin support portions 31B, 31, 31D, 31E.

The same is true with respect to the pin support portions 32A through 32F, the sloped portions 32T, 32U, and the imaginary linear draw-out portion 50A'. In FIG. 4, the imaginary draw-out portion 50A' is coincident with an actual draw-out portion 50A in the front elevational view.

Terminal electrodes 31G, 31H, 31I, 31J, 31K, 31L in the form of pin terminals protrudes in −Z direction from free end surfaces of the pin support portions 31A, 31B, 31C, 31D, 31E, 31F coaxially therewith. A distance from the bottom surface 31Z to each free end of each of the terminal electrodes 31G through 31L is equal to one another. The same is true with respect to the relationship among terminal electrodes 32G, 32H, 32I, 32J, 32K, 32L, the pin support portions 32A, 32B, 32C, 32D, 32E, 32F, and the bottom surface 32Z.

Six conductive wires 50 are wound over the bobbin 20. Each conductive wire 50 includes a copper wire coated with an electrically insulating layer. A first conductive wire 50 is directly wound over the sleeve portion 21, and an insulating tape is formed over the winding portion. A second conductive wire 50 is wound over the first insulating tape, and then a second insulating tape is formed over the second winding portion. In this way, totally six conductive wires 50 and six insulating tapes including an uppermost tape 80 are alternately provided over the sleeve portion 21. Each one end portion of each conductive wire 50 is wound over each base end portion of each of the terminal electrodes 31G through 31L at a position close to each of the pin support portions 31A through 31F and is electrically connected to each terminal electrode by soldering. Similarly, each another end portion of each conductive wire 50 is wound over each base end portion of each of the terminal electrodes 32G through 32L at a position close to each of the pin support portions 32A through 32F and is electrically connected to each terminal electrode by soldering. Each wire has a first part wound over the sleeve portion 21 as a winding portion, and a second part as draw-out portions 50A drawn out from the winding portion to the terminal electrode.

More specifically, as shown in FIG. 3, on the terminal base 31, draw-out portions 50A electrically connected to the terminal electrodes 31G, 31L are drawn out from the winding portion and are engaged with the slope portions 31T, 31U and are contacted with the outer peripheral surfaces of the pin support portions 31B, 31E. The draw-out portions 50A are then wound over the base end portions of the terminal electrodes 31G, 31L at a position close to the pin support portions 31A, 31F (FIG. 4), and are then electrically connected to the terminal electrodes 31G, 31L by soldering.

On the other hand, other draw-out portions 50A electrically connected to the terminal electrodes 31H, 31I, 31J, 31K are drawn out from the winding portion and are engaged with the wire following rectangular protrusions 31O, 31P, 31Q, 31R, 31S. The draw-out portions 50A are then wound over the base end portions of the terminal electrodes 31H, 31I, 31J, 31K at a position close to the pin support portions 31B, 31D, 31C, 31D, 31E (FIG. 4), and are then electrically connected to the terminal electrodes 31H, 31I, 31J, 31K by soldering. The same is true with respect to draw-out portions 50A on the terminal base 32.

Soldering of the draw-out portions 50A to the terminal electrodes is performed by dipping the draw-out portions 50 wound over the terminal electrodes into a molten solder. More specifically, oblique posture of the terminal base 31 is maintained such that lower end faces of the two pin support portions 31A, 31B are on an identical horizontal plane parallel to a top surface of the molten solder, and the terminal base 31 is moved downward with maintaining the oblique posture so as to simultaneously dip the end portions of the draw-out portions 50A on the terminal electrodes 31G and 31H. Thus, simultaneous soldering is achieved with respect to these end portions 50A. The same is true with respect to the end portions of the draw-out portions 50A in association with the terminal electrodes 31K and 31L.

Regarding soldering of the remaining draw-out portions 50A to the remaining terminal electrodes 31I, 31J, these terminal electrodes 31I, 31J are moved downward into the molten solder while maintaining their vertical orientation with respect to the surface of the molten solder, so that the end portions of the draw-out portion 50A in association with the terminal electrodes 13I, 31J are subjected to simultaneous soldering. The same is true with respect to the soldering of the draw-out portions to the terminal electrodes 32G through 32J. In this way, deposition of surplus solder onto the pin support portions 31A through 31F, and 32A through 32F can be prevented.

The imaginary linear draw-out portion 50A' intersects with the pin support portion 31B as shown in FIG. 3, and the protruding length of the pin support portion 31B from the bottom surface 31Z of the terminal base 31 is greater than that of the pin support portion 31A as shown in FIG. 4. Further, the protruding length of the pin support portion 31B provides the free end (lower end) of the pin support portion 31B positioned downstream of the imaginary linear draw-out portion 50' in the −Z direction as shown in FIG. 4. Accordingly, this pin support portion 31B can prevent the conductive wire 50 electrically connected to the terminal electrode 31G from being mechanically interfered with the terminal electrode 31H.

In the same way, the pin support portions 31E, 32B, 32E can avoid mechanical interference of the draw-out portions 50A electrically connected to the terminal electrodes 31L, 32G, 32L with the terminal electrodes 31K, 32H, 32K.

Various modifications are conceivable. For example, in the above-described embodiment, each draw-out portion 50A is wound at each base portion of each terminal electrode at a position near each pin support portion. However, each draw-out portion or one of the draw-out portions can be wound at a portion other than the base end portion, for example, near the free end portion of each terminal electrode.

Figure 5:
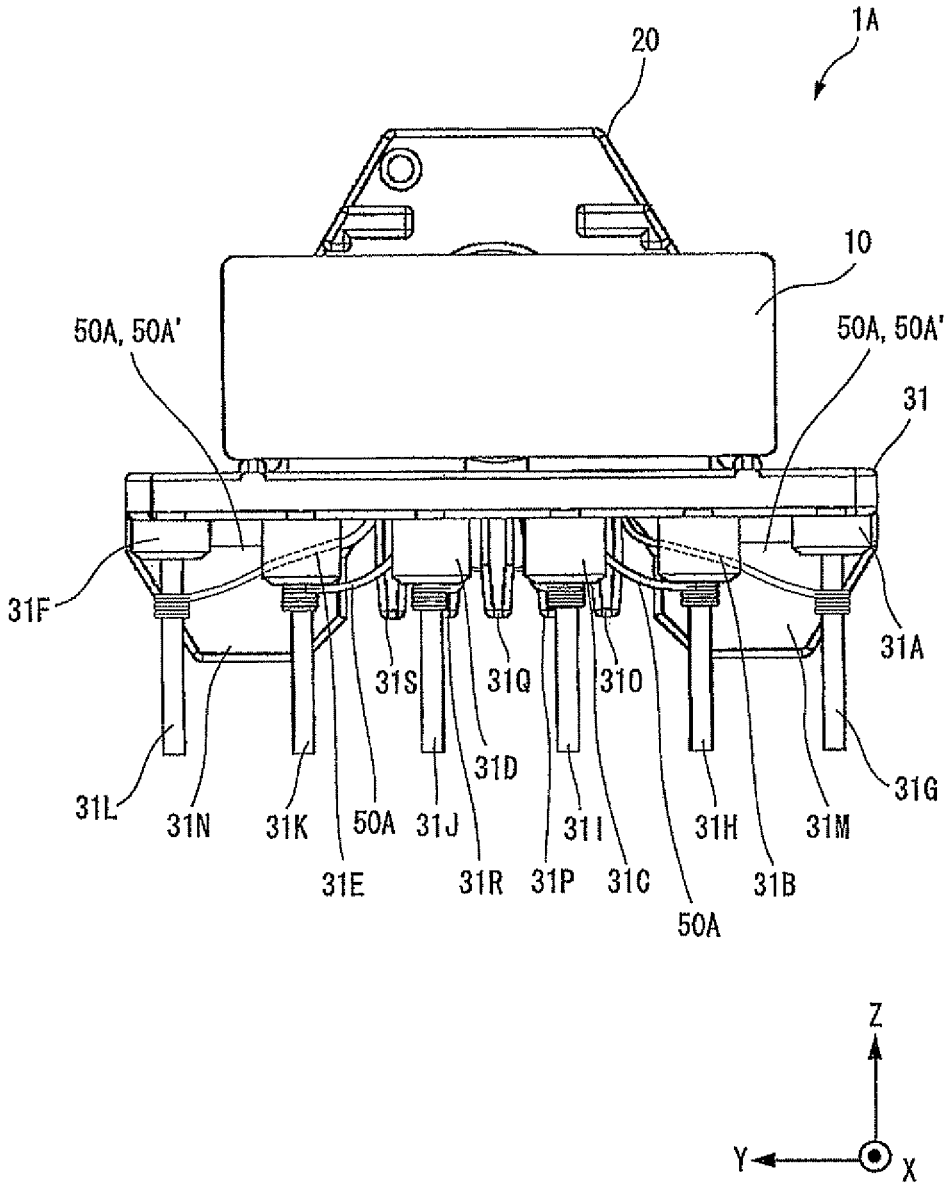
FIG. 5 is a front elevational view of a coil assembly according to a first modification to the embodiment.

More specifically, as shown in FIG. 5, in a coil assembly 1A shown in FIG. 5, the rightmost draw-out portion 50A is wound over the first pin terminal 31G and electrically connected thereto at a position remote from the free end face of the first pin support portion 31A and positioned downstream, in the protruding direction (in the direction), of the free end face of the second pin support portion 31B. The same is applied to the draw-out portion 50A connected to the pin terminal 31L.

With this arrangement, each free end portion of each terminal electrode can be simultaneously dipped into the molten solder while maintaining vertical orientation of terminal electrodes with respect to the surface of the molten solder for simultaneous soldering the all draw-out portions to the all terminal electrodes.

Figure 6:
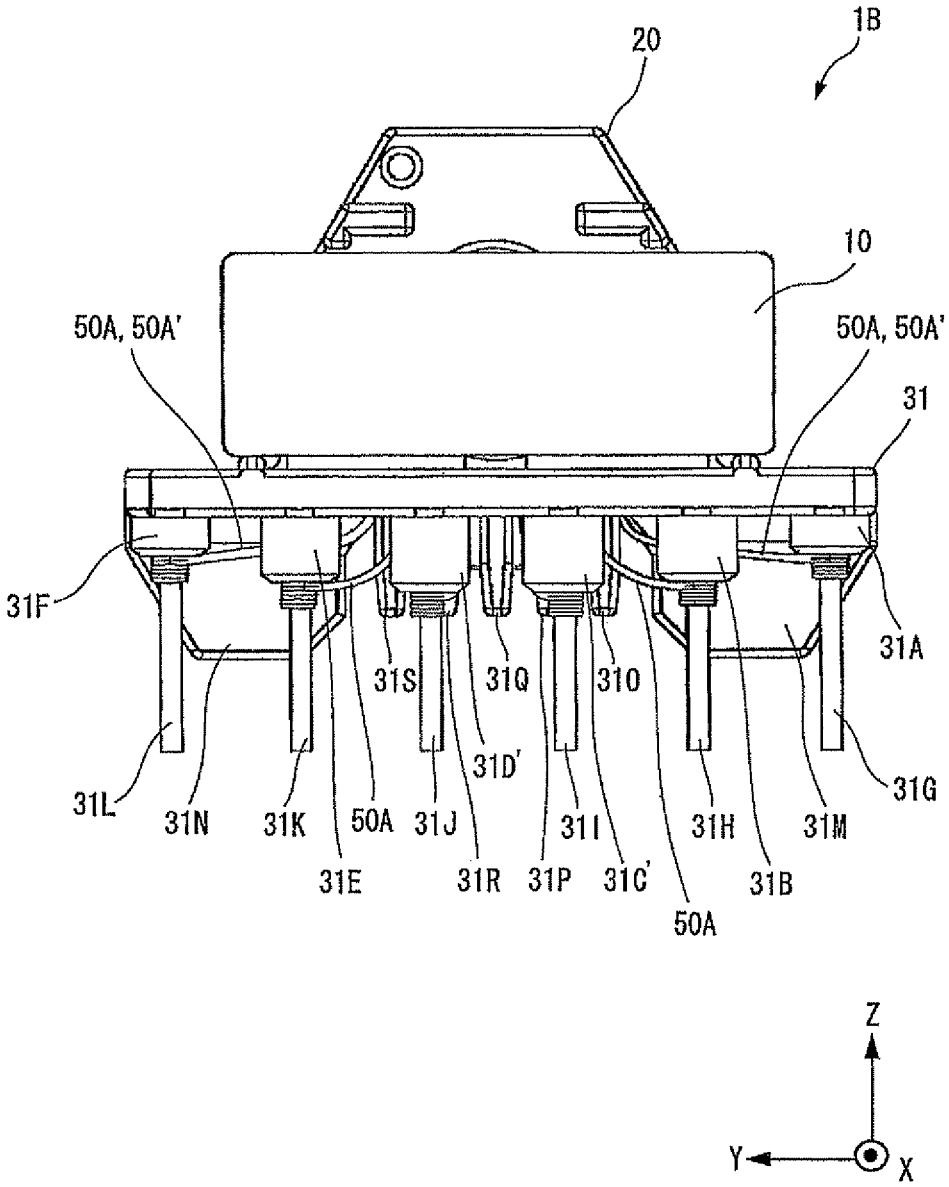
FIG. 6 is a front elevational view of a coil assembly according to a second modification to the embodiment.

Further, in the above-described embodiment, protruding length of the pin support portion 31B, 31E (or 32B, 32E) is equal to that of the pin support portion 31C, 31D (or 32C, 32D). However, the protruding length of the pin support portion 31B, 31E (32B, 32E) can be different from that of the pin support portion 31C, 31D (32C, 32D). For example, in a coil assembly 1B shown in FIG. 6, regarding pin support portion 31B, 31C' protruding length of the most upstream side pin support portion 31C' can be greater than that of the pin support portion 31B positioned immediate downstream of the pin support portion 31C' in the −Y direction. The same is true with respect to the pin support portions 31D', 31E. Protruding length of the most upstream side pin support portion 31D' can be greater than that of the pin support portion 31E positioned immediate downstream of the pin support portion 31D' in the +Y direction. Thus, mechanical interference of the draw-out portions 50A electrically connected to the terminal electrodes 31H, 31K with the terminal electrodes 31I, 31J can be prevented by the elongated pin support portions 31C' and 31D'.

Further, the number of the conductive wires and the terminal electrodes and shape of the bobbin and the core are not limited to the above-described embodiment. Furthermore, the coil assembly is not limited to the transformer.

While the invention has been described in detail with reference to the specific embodiment thereof, it would be apparent to those skilled in the art that various changes and modifications may be made therein without departing from the spirit of the invention.

What is claimed is:

1. A coil assembly to be mounted on a circuit board comprising:

a bobbin made from an electrically insulating material and including a wound portion having an end portion, a terminal base positioned at the end portion, and a wire engaging portion protruding from a bottom surface of the terminal base;

at least one electrically conductive wire formed with an electrically insulation coating and including a winding portion wound over the wound portion and draw-out portions each drawn out from the winding portion and engaged with the wire engaging portion;

a first pin support portion and a second pin support portion protruding in a protruding direction from the bottom surface of the terminal base; and a first pin terminal protruding in the protruding direction from a free end face of a first pin support portion and supported thereto, and a second pin terminal protruding in the protruding direction from a free end face of the second pin support portion and supported thereto, each of the draw-out portions being electrically connected to associated one of the pin terminals, the pin terminals being configured to extend through the circuit board in the protruding direction which is substantially perpendicular to a surface of the circuit board;

wherein the second pin support portion provides a protruding length from the terminal base greater than that of the first pin support portion, and the free end face of the second pin support portion being positioned downstream, in the protruding direction, of an imaginary linear draw-out portion directed linearly from the wire engaging portion to the first pin terminal, such that the second pin support portion is positioned and sized to intersect with the imaginary linear draw-out portion.

2. The coil assembly as claimed in claim 1, wherein the draw-out portion is wound over the first pin terminal and electrically connected thereto at a position remote from the free end face of the first pin support portion and positioned downstream, in the protruding direction, of the free end face of the second pin support portion.

3. The coil assembly as claimed in claim 1, wherein at least three pin support portions including the first pin support portion, the second pin support portion, and a third pin support portion are arrayed in one direction, the third pin support portion being positioned at a most upstream end in the one direction, the second pin support portion being positioned immediately downstream of the third pin support portion in the one direction, and the first pin support portion being positioned immediately downstream of the second pin support portion in the one direction; and, wherein the third pin support portion has a protruding length from the terminal base greater than that of the second pin support portion.

4. The coil assembly as claimed in claim 3, wherein the first pin support portion, the second pin support portion, and the third pin support portion protrude in the protruding direction from the bottom surface of the terminal base.

5. The coil assembly as claimed in claim 1, wherein the bobbin has a sleeve portion having one axial end and another axial end; and wherein the terminal base comprises a first terminal base positioned at the one axial end, and a second terminal base positioned at the another axial end: and wherein the first pin support portion and the second pin support portion are provided at each of the first terminal base and the second terminal base; and, wherein the conductive wire comprises:

a first wire including a winding portion wound over the sleeve portion and has a first draw-out portion electrically connected to one of the first pin terminal and the second pin terminal at one of the first terminal base and the second terminal base, and has a second draw-out portion electrically connected to one of the first pin terminal and the second pin terminal at remaining one of the first terminal base and the second terminal base; and a second wire including a winding portion wound over the sleeve portion and has a third draw-out portion electrically connected to remaining one of the first pin terminal and the second pin terminal at one of the first terminal base and the second terminal base, and has a fourth draw-out portion electrically connected to remaining one of the first pin terminal and the second pin terminal at remaining one of the first terminal base and the second terminal base.

* * * * *